US007500876B2

(12) United States Patent
Chang

(10) Patent No.: US 7,500,876 B2
(45) Date of Patent: Mar. 10, 2009

(54) SHIELDED RECEPTACLE CONNECTOR

(75) Inventor: Ming-Yung Chang, Hsin-Tien (TW)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 11/891,829

(22) Filed: Aug. 13, 2007

(65) Prior Publication Data

US 2008/0045084 A1 Feb. 21, 2008

(30) Foreign Application Priority Data

Aug. 16, 2006 (TW) ..... 95214455 U

(51) Int. Cl.
*H01R 13/648* (2006.01)

(52) U.S. Cl. ..... 439/607; 439/608

(58) Field of Classification Search ..... 439/607, 439/608

See application file for complete search history.

(56) References Cited

U.S. PATENT DOCUMENTS

2006/0234530 A1* 10/2006 Chung ..... 439/79

* cited by examiner

*Primary Examiner*—Briggitte R Hammond
*Assistant Examiner*—Vanessa Girardi
(74) *Attorney, Agent, or Firm*—Jackson Walker, LLP

(57) ABSTRACT

A receptacle connector has an insulative housing, a plurality of terminals and a shell. The insulative housing has a mounting segment and a tongue segment. The terminals are mounted securely on the insulative housing and held by the tongue segment. The shell covers the tongue segment of the insulative housing and the terminals and has a space. In the space, an outer edge and two stoppers being inclined tabs are arranged to block and prevent an unmatched plug connector from being inserted wrongly into the space so that the receptacle connector would not be damaged by the wrong insertion.

5 Claims, 3 Drawing Sheets

SHIELDED RECEPTACLE CONNECTOR

BACKGROUND OF THE INVENTION

1. Field of the Invention

The present invention relates to a connector, and more particularly to a shielded receptacle connector that has a pair of stoppers to avoid the wrong insertion of an unmatched plug connector.

2. Description of Related Art

The Universal Serial Bus Implementers Forum (USB IF) has designed a new standard, Micro USB, to replace Mini USB standard that is applied to many portable electronic devices such as digital cameras, MPEG-1 Audio Layer 3 (MP3) players and external hard drives.

However, standard micro USB receptacle connectors are not designed to prevent the unmatched plug connectors from being inserted wrongly thereinto.

To overcome the shortcomings, the present invention, provides a shielded receptacle connector to mitigate or obviate the aforementioned problems.

SUMMARY OF THE INVENTION

The main objective of the invention is to provide a shielded receptacle connector that has a pair of stoppers to avoid the wrong insertion of an unmatched plug connector.

A shielded receptacle connector in accordance with the present invention comprises an insulative housing, a plurality of terminals and a shell. The insulative housing has a mounting segment and a tongue segment. The terminals are mounted securely on the insulative housing and held by the tongue segment. The shell covers the tongue segment of the insulative housing and the terminals and has a space. The space has an outer edge and two stoppers being inclined tabs are arranged to block and prevent an unmatched plug connector from being inserted wrongly into the space so that the shielded receptacle connector would not be damaged by the wrong insertion.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
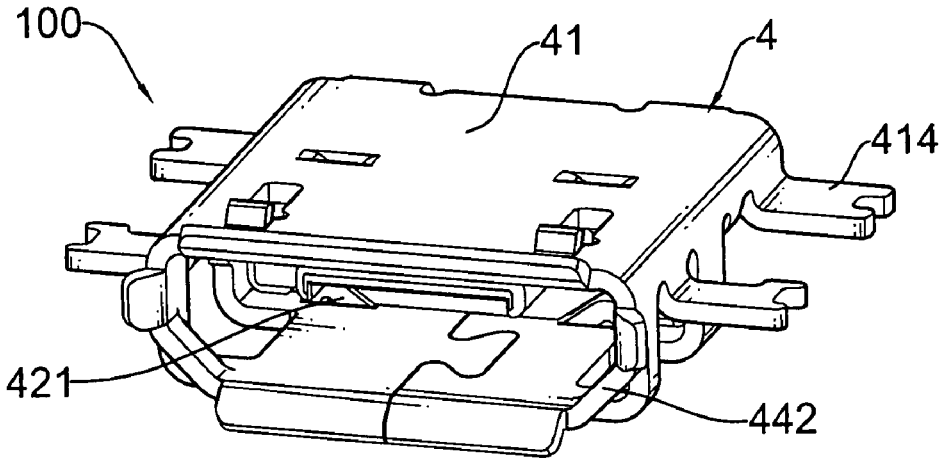
FIG. 1 is a perspective view of a shielded receptacle connector in accordance with the present invention.
Figure 2:
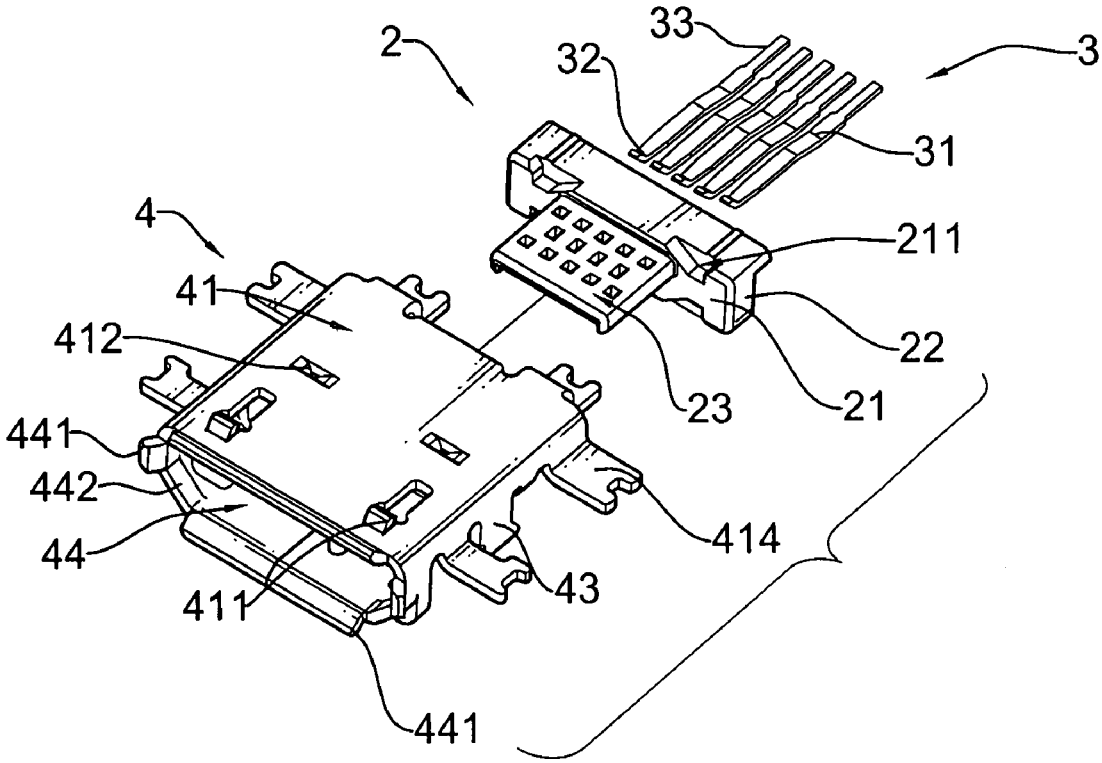
FIG. 2 is an exploded perspective view of the shielded receptacle connector in FIG. 1.
Figure 3:
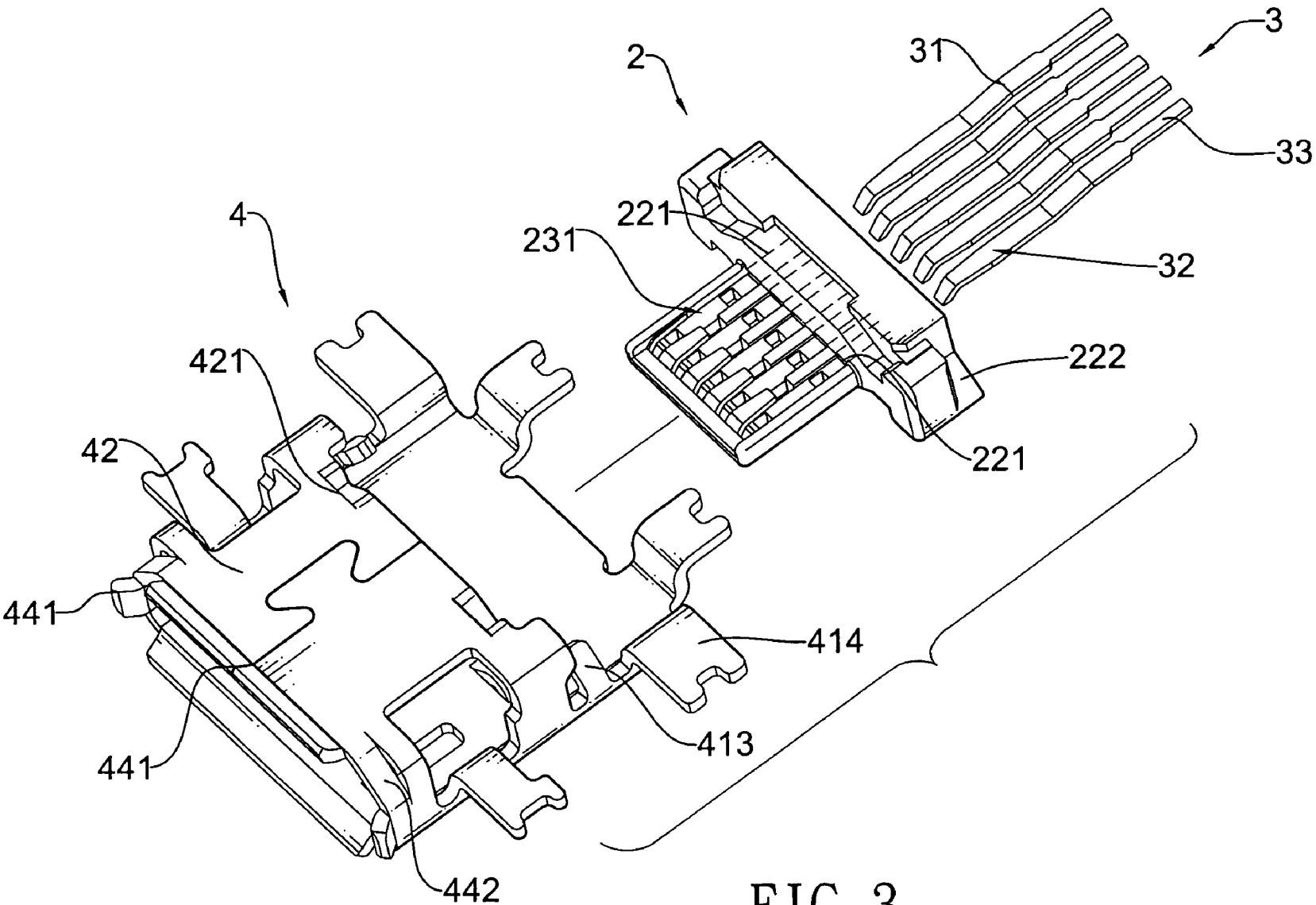
FIG. 3 is another exploded perspective view of the shielded receptacle connector in FIG. 1.
Figure 4:
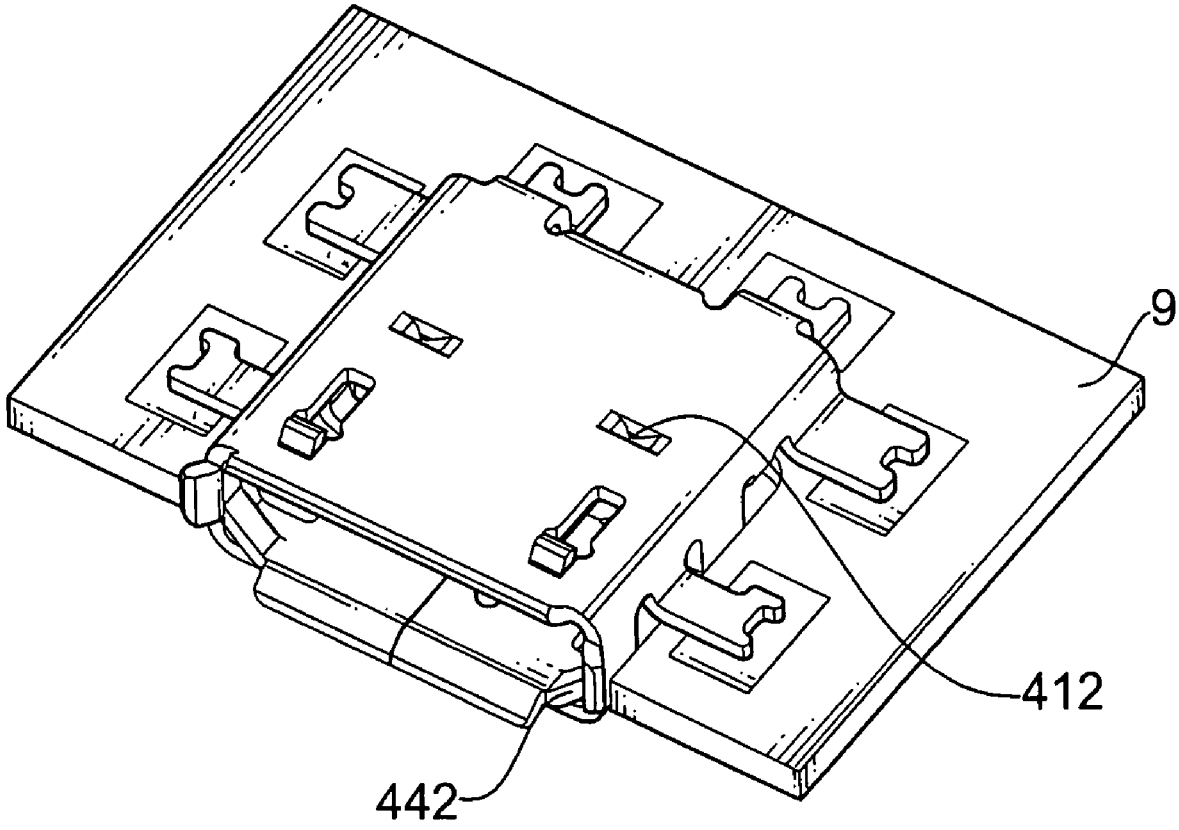
FIG. 4 is an operational perspective view of the shielded receptacle connector in FIG. 1 connected with a printed circuit board.

With reference to FIGS. ito 4, a shielded receptacle connector (100) in accordance with the present invention may be a micro-USB receptacle connector to accommodate and hold a mating micro-USB plug connector, is mounted on a printed circuit board (P08) (9) and comprises an insulative housing (2), a plurality of terminals (3) and a shell (4).

The insulative housing (2) has a mounting segment (22) and a tongue segment (23).

The mounting segment (22) has a front (21), a rear, a top, a bottom and two opposite sides and may further have a plurality of mounting holes (221), two sets of front positioning cutaways (211) and a pair of rear positioning cutaways (222). The mounting holes (221) are defined longitudinally through the mounting segment (22). The sets of the front positioning cutaways (211) are defined in the front (21) and are located respectively adjacent to the top and the bottom. The rear positioning cutaways (222) are defined in the rear and are located respectively at the sides.

The tongue segment (23) is formed on and extends longitudinally from the front (21) of the mounting segment (22) and has a top and a bottom and may further have a plurality of passageways (231). The passageways (231) are defined in the bottom of the tongue segment (23) and communicate respectively with the mounting holes (221).

The terminals (3) are mounted securely in the insulative housing (2), are held by the tongue segment (23) and may correspond respectively to the mounting holes (221) and correspond respectively to the passageways (231). Each terminal (3) may have a body portion (31), a resilient contacting portion (32) and a soldering portion (33).

The body portion (31) is mounted securely in a corresponding mounting hole (221).

The resilient contacting portion (32) is formed on and protrudes longitudinally from the body portion (31) and is mounted in a corresponding passageway (231) in the tongue segment (23).

The soldering portion (33) is formed on and protrudes longitudinally from the body portion (31), extends out of the rear of the mounting segment (22) and is mounted and connected with the PCB (9).

The shell (4) may be made of metal, covers the tongue segment (23) of the insulative housing (2) and the terminals (3) and has a top (41), a bottom (42), two opposite sidewalls (43), a front, a rear and a space (44). The shell (4) may further have at least one hook (411), two sets of front mounting protrusions (412, 421), a pair of rear mounting protrusions (413) and a plurality of soldering tabs (414).

The space (44) is defined in the front of the shell (4), accommodates the tongue segment (23) of the insulative housing (2) and the resilient contacting portions (32) of the terminals (3) and has an outer edge and two stoppers (442) and may further have four guiding tabs (441). The stoppers (442) are defined on the outer edge of the space (44). Each stopper (442) is an inclined tab formed between the bottom (42) and one sidewall (43) of the shell (4) and blocks and prevents an unmatched plug connector from being inserted wrongly into the space (44). The guiding tabs (441) are formed on the outer edge arranged in the space (44), correspond respectively to the top (41), the bottom (42) and the sidewalls (43), are inclined outward from the space (44) and may guide a corresponding plug connector to move smoothly into the space (44).

The at least one hook (411) is formed on and protrudes up from the top (41) of the shell (4) near the front by stamping and utilized to securely hold the shell of the mating plug connector to the shielded receptacle connector (140).

The sets of front mounting protrusions (412, 421) are formed respectively on and protrude respectively from the top (41) and the bottom (42) of the shell (4) by stamping and extend in the space (44). The front mounting protrusions (412, 421) are securely mounted respectively in the front positioning cutaways (211) in the insulative housing (2) to securely hold the insulative housing (2) in the shell (4). The front mounting protrusions (412, 421) block and prevent a corresponding plug connector from being inserted excessively into the space (44) to break the shielded receptacle connector (100).

The rear mounting protrusions (413) are formed respectively on and protrude respectively from the sidewalls (43) by stamping, extend in the space (44) and are mounted respectively in the rear positioning cutaways (222) to further securely hold the insulative housing (2) in the shell (4). The rear mounting protrusions (413) cooperate with the front mounting protrusions (412, 421) to prevent the insulative housing (2) from sliding longitudinally in the shell (4).

The soldering tabs (414) are formed on and protrude out from the shell (2) by stamping and are mounted on the PC8 (9) so that the shielded receptacle connector (100) is securely mounted on the PC8 (9).

To manufacture the shielded receptacle connector (100), the terminals (3) are placed in a mold and molded by an insert molding process to form the insulative housing (2) on the terminals (3). Then, the insulative housing (2) with the terminals (3) is mounted in a semi- finished shell. The semi-finished shell experiences a stamping process that stamps the front mounting protrusions (412, 421) and the rear mounting protrusions (413) into the insulative housing (2) and the at least one hook (411). The soldering tabs (414) are stamped out to form the shell (4) and finish the shielded receptacle connector (100).

The stoppers (442) prevent non-corresponding plug connectors from being inserted wrongly into the space, (44) so that the insulative housing (2) and terminals (3) inside the space (44) would not be damaged by the wrong insertion. Furthermore, the stamped front and rear protrusions (412, 421, 413) securely hold the insulative housing (2) so that the shielded receptacle connector (100) is firm and durable.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A shielded receptacle connector comprising:

an insulative housing having a mounting segment having a front, a rear, a top, a bottom, two opposite sides and further having two sets of front positioning cutaways defined in the front and located respectively adjacent to the top and the bottom of the insulative housing; and a pair of rear positioning cutaways defined in the rear, and the rear positioning cutaways located respectively at the sides; and a tongue segment formed an and extending longitudinally from the front of the mounting segment and having a top and a bottom; and a plurality of terminals mounted in the insulative housing and held by the tongue segment;

a shell covering the tongue segment of the insulative housing and the terminals and having a top, a bottom, two opposite sidewalls, a front, a rear and a space defined in the front of the shell, accommodating the tongue segment of the insulative housing and having an outer edge; and two stoppers defined on the outer edge of the space and each stopper being an inclined tab formed between the bottom and one sidewall of the shell;

the shell further having two sets of front mounting protrusions formed on and protruding respectively from the top, and the bottom of the shell by stamping, extending in the space, and the front mounting protrusions mounted respectively in the front positioning cutaways in the insulative housing; and a pair of rear mounting protrusions, and the rear mounting protrusions formed respectively on and protruding respectively from the sidewalls by stamping, extending in the space and mounted respectively in the rear positioning cutaways in the insulative housing.

2. The shielded receptacle connector as claimed in claim 1, wherein the mounting segment further has a plurality of mounting holes defined longitudinally through the mounting segment;

the tongue segment further has a plurality of passageways defined in the bottom of the tongue segment and communicating respectively with the mounting holes; and the terminals correspond respectively to the mounting holes, correspond respectively to the passageways and each terminal has a body portion mounted in a corresponding mounting hole;

a resilient contacting portion formed on and protruding longitudinally from the body portion and mounted in a corresponding passageway in the tongue segment; and a soldering portion formed on and protruding longitudinally from the body portion and extending out of the rear of the mounting segment.

3. The shielded receptacle connector as claimed in claim 2, wherein the shell further has at least one hook formed on and protruding up from the top of the shell near the front by stamping.

4. The shielded receptacle connector as claimed in claim 3, wherein the shell further has four guiding tabs formed on the outer edge arranged in the space, corresponding respectively the top, the bottom and the sidewalls of the shell and inclined outward from the space.

5. The shielded receptacle connector as claimed in claim 4, wherein the shell further has a plurality of soldering tabs formed on and protruding out from the shell by stamping.

* * * * *